US006227923B1

(12) United States Patent
Johnson

(10) Patent No.: US 6,227,923 B1
(45) Date of Patent: May 8, 2001

(54) FOOT PROPULSION DEVICE FOR FLOAT TUBE USERS

(76) Inventor: Carroll L. Johnson, 2658 Paradise Way, Grand Junction, CO (US) 81506

( * ) Notice: Subject to any disclaimer, the term of this patent is extended or adjusted under 35 U.S.C. 154(b) by 0 days.

(21) Appl. No.: 09/507,031

(22) Filed: Feb. 18, 2000

Related U.S. Application Data

(60) Provisional application No. 60/120,861, filed on Feb. 19, 1999.

(51) Int. Cl.[7] ..... A63B 31/11

(52) U.S. Cl. ..... 441/61; 441/62; 441/63

(58) Field of Search ..... 441/61–64

(56) References Cited

U.S. PATENT DOCUMENTS

| | | | | |
|---|---|---|---|---|
| 1,326,471 | * | 12/1919 | Becherer | 441/63 |
| 2,094,532 | * | 9/1937 | Glad | 441/62 |
| 4,664,639 | * | 5/1987 | Schneider | 441/61 |
| 5,151,060 | * | 9/1992 | Lam | 441/62 |
| 5,531,621 | * | 7/1996 | Johnson | 441/61 |
| 5,593,333 | * | 1/1997 | Johnson | 441/62 |
| 5,632,662 | * | 5/1997 | Cadorette | 441/63 |

* cited by examiner

*Primary Examiner*—Sherman Basinger
(74) *Attorney, Agent, or Firm*—John L. Isaac; Isaac & Associates

(57) ABSTRACT

A fin assembly for attachment to the foot covering of a float tube user is disclosed, the foot covering having a sole, a toe portion and a heel portion. The assembly includes a base member having a front portion, a rear portion, an upper surface and a lower surface. A mechanism is provided for releasably attaching the upper surface of the base member to the sole of the foot covering. A fin member is provided and has a front end portion, a rear end portion, a top surface and a bottom surface. A hinge apparatus mounts the front end portion of the fin member to the front portion of the base member so that the fin member is pivotally movable between a retracted position wherein the fin member top surface is positioned proximate the base member lower surface, and a base operational position wherein the fin member rear end portion projects at an angle below the base member lower surface. A device selectively secures the fin member in its retracted position, and another device selectively secures the fin member in its base operational position. A mechanism is provided to enable the fin member, when secured in its base operational position, to vary between a first fully extended operating position wherein the fin member rear end portion is fully extended to maximize resistance to flow of water against the fin member top surface as the fin member is moved in a rearward direction relative to the user for propelling the user forwardly in the water, and a second return operating position wherein the fin member rear portion is feathered rearwardly and upwardly toward the base member lower surface to provide substantially reduced resistance to flow of water across the fin member bottom surface as the fin member is moved in a forward direction relative to the user. Finally, a mechanism is provided to limit the maximum angle between the fin member in its first fully extended operating position and the plane of the base member lower surface.

35 Claims, 8 Drawing Sheets

FIG. 1
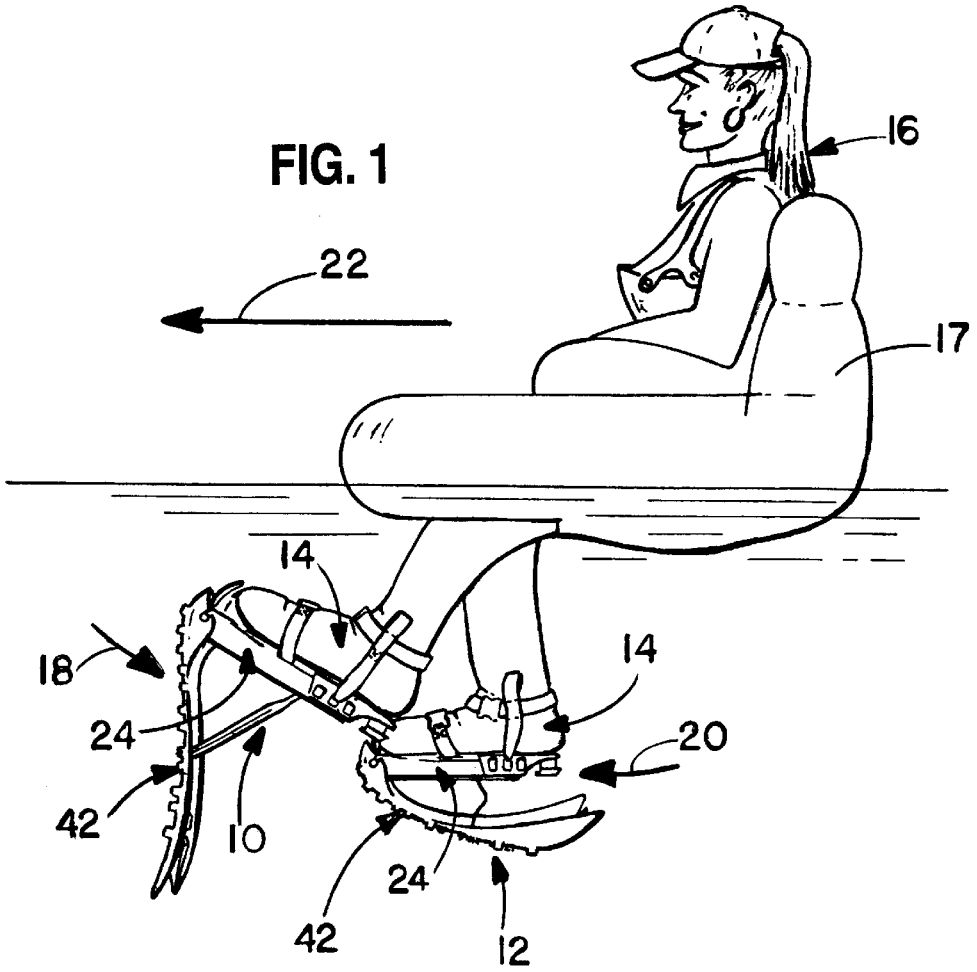
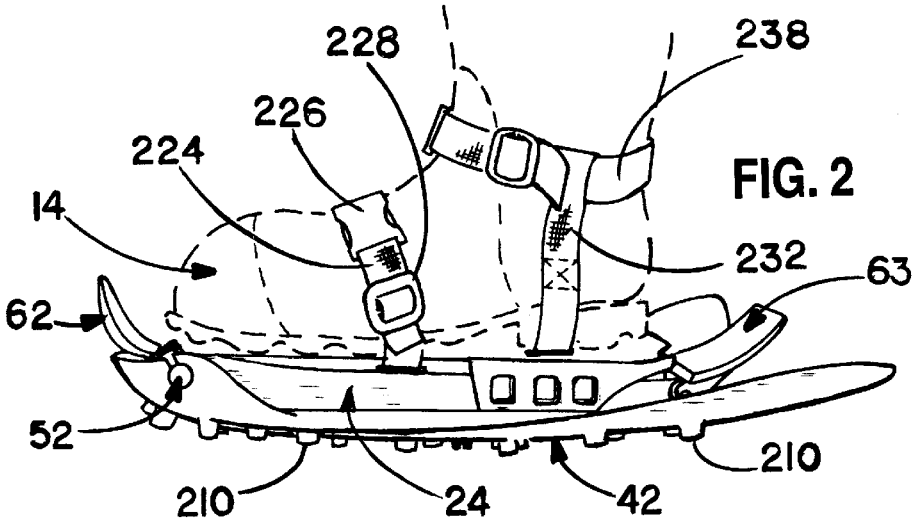
FIG. 2

FIG. 7
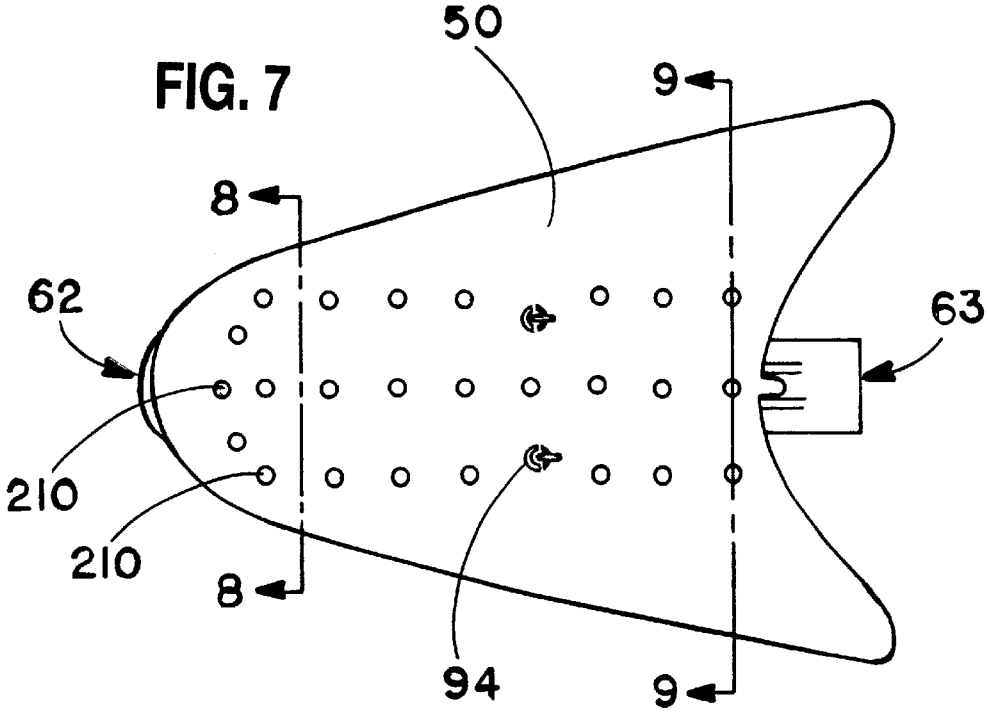
FIG. 8
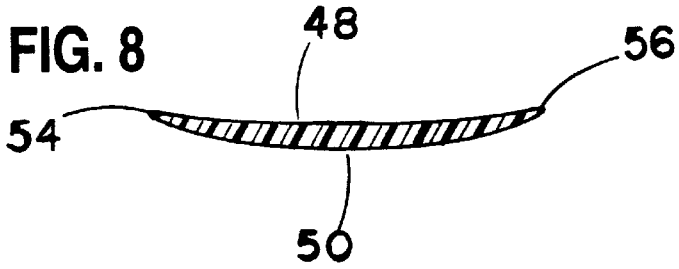
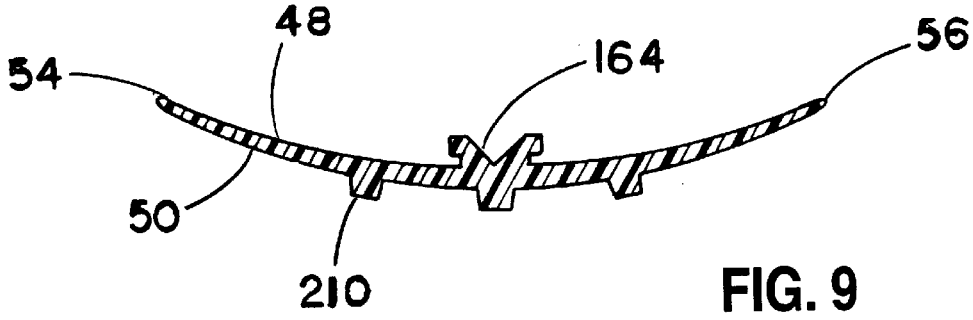
FIG. 9

FIG. 17
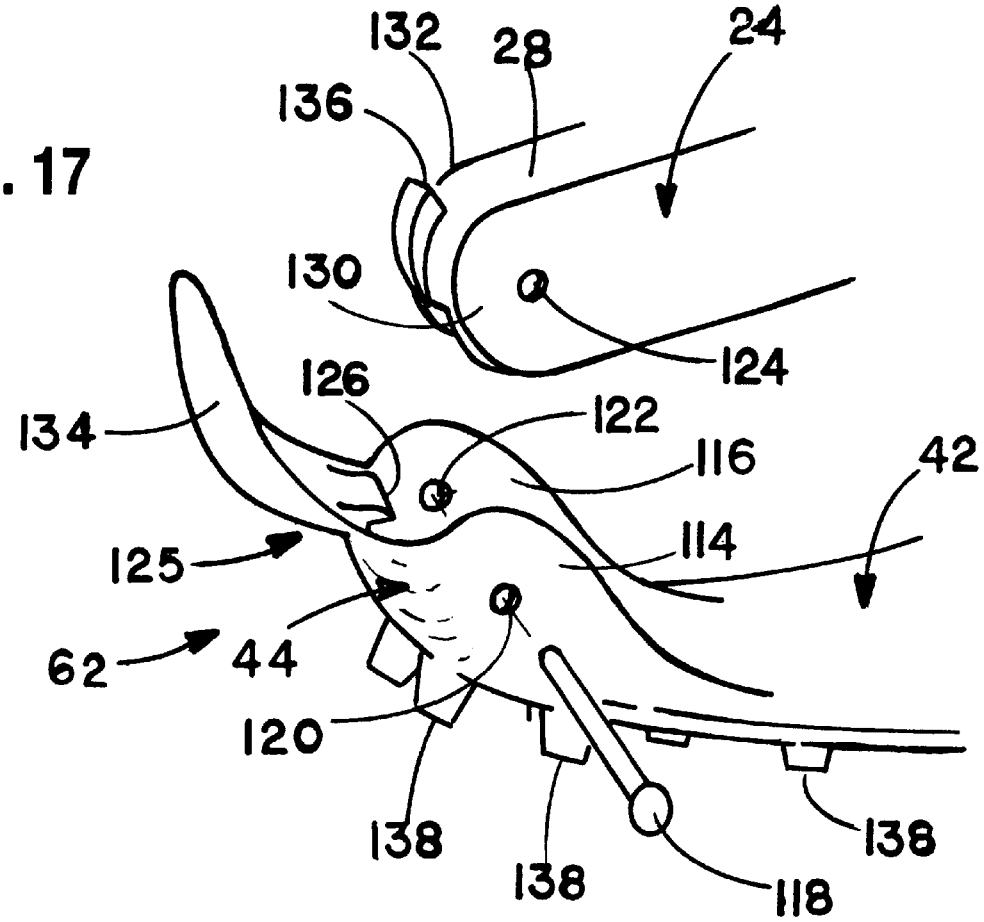
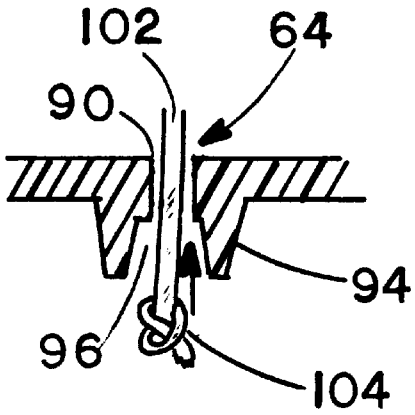
FIG. 18

FOOT PROPULSION DEVICE FOR FLOAT TUBE USERS

RELATED PATENT APPLICATIONS AND PATENTS

This application claims benefits under 35 U.S.C. 119(e) for of U.S. provisional patent application Ser. No. 60/120,861, filed Feb. 19, 1999. This application also relates to U.S. Pat. No. 5,645,460, U.S. Pat. No. 5,593,333, and U.S. Pat. No. 5,531,621, the contents of which are specifically incorporated herein by reference.

BACKGROUND OF THE INVENTION

1. Field of the Invention

This invention relates generally to a propulsion mechanism for use with float tubes, also known as belly boats, pontoon boats, and other floatation devices commonly used in fishing, duck hunting, and other aquatic pursuits and, more particularly, to a foot fin assembly for propelling the user of such devices while in the water. Specifically, the present invention relates to an improved foot fin assembly for use in propelling the user of a float tube or other similar floatation device in a forwardly facing direction while in the water while simultaneously permitting the user of such a foot fin assembly to walk in a forwardly facing direction in shallow water and on land without removing the fin assembly.

2. Description of the Prior Art

In general, users of float tubes and similar devices for fishing and other aquatic pursuits incorporate some type of propulsion devices on their feet to assist in moving about the water's surface. Most float tube fins presently used are similar in design to the foot fins used by swimmers and divers. Illustrations of such devices include those shown in U.S. Pat. No. 3,183,529, U.S. Pat. No. 4,857,024, U.S. Pat. No. 4,929,206, U.S. Pat. No. 4,940,437 and U.S. Pat. No. 5,597,336. Such devices operate by movement of the user's legs and feet in a flutter kick which propels an outstretched swimmer or diver in a forward direction. However, when such devices are utilized by a person seated in or on a float tube or similar device, they propel the user rearwardly or backwardly relative to the direction he or she is facing. This direction is generally opposite the direction the float tube user wishes to move when pursuing rising fish or in moving to another spot located in front of him or her. Moreover, the efficiency of such prior art fins is low so that the use of such devices when traveling any type of a distance in the water while using a float tube or similar device is generally very strenuous and tiring.

In addition, these types of fin devices limit normal walking foot movement due to their forward extending fin portions, which creates a risk of tripping and falling while walking with the fins on. Walking in marginal water to enter or exit a body of water is particularly hazardous, for in addition to the clumsiness of the protruding fins and the restriction of movement and visibility caused by the wearing of the float tube, the walker has to overcome the water's resistance on the fins with each step. As a consequence, most float tube users of forwardly extending fins walk backwards to enter and exit the water. While this procedure alleviates the protruding fin problem, such backward walking with a bulky float tube in place presents yet another problem since it creates a significant danger of falling and injury to the float tube user.

The process of donning and removing a float tube while wearing such forwardly extending prior art fins is also difficult and hazardous. For example, the bulk and shape of a donut shaped float tube surrounding a user's body limits a user's movement, necessitating that the fins are attached to the user's feet prior to donning the float tube. In such an instance, with the float tube lying flat on the ground and the fins attached to the user's feet, the user balances on one foot while stepping over the circumference of the tube with the other foot to insert that foot with fin into the leg opening of the float tube seat. Thus straddling the tube, the user then shifts his or her balance to the foot now inside the tube so as to lift the opposite foot with fin over the tube and insert it also into the leg opening of the seat. At this particular point, balancing is especially difficult presenting a danger of falling. The forward extension of such prior art fins, their general configuration and size, and the constriction of the seat of an annular float tube make it extremely awkward to insert both feet with fins in place into the leg opening of a float tube. Balancing is especially difficult while bending over to maneuver the unwieldy tube into position to facilitate inserting the forward extending fin of the second foot into the leg opening.

As the result of such difficulties, several fin structures have been designed to provide a means of forward propulsion by float tube users. Moreover, designs have been provided wherein a single paddle is secured to an existing shoe of a float tube user. Such designs include U.S. Pat. No. 2,395,844, U.S. Pat. No. 4,664,639 and U.S. Pat. No. 5,527,196. Other designs such as U.S. Pat. No. 2,276,082 and U.S. Pat. No. 3,432,868 have provided elongated or funnel shaped fins attached to the outside sides of the legs of a float tube user as an integral part of wading boots or waterproof garments for float fishing. An unpatented device known as the Paddle Pusher by Fishmaster Manufacturing Co. of Oklahoma City, Okla., provides side paddles to be worn on existing tennis shoes or other footgear. The design of these types of fins compel the float tube user to assume a forced, unnatural position in the float tube during use. Moreover, these designs are generally inefficient, lacking the advantage of a longer arc of leg movement in the water which can be gained only by positioning the fin in an operating position underneath the foot of a user. They also lack the advantage of a fin biased to an operating position from which the fin will generate usable thrust more rapidly than a fin which must be initially extended to its operating position by movement through the water.

The design and construction of a float tube seat typically places a user thereof in the posture of a person seated in a chair with his or her legs and feet extended generally outwardly and forwardly. In such a position the kick is restricted to lower leg movements with the legs pivoting at the knees, not at the hips as is assumed in many prior art swim fin-like devices. Use of the fin disclosed in U.S. Pat. No. 4,664,639 in which the fin is integrally secured as part of the sole of the shoe or as part of a sleeve that fits over the shoe requires the user to lean forward against the designed posture of the float tube in order to position his or her body and legs in a generally upright vertical plane to provide a sufficient length of kick to make adequate use of the device. This is due to the fact that the integral fin flap of this device is by its nature biased toward its retracted position against the boot sole necessitating unusual motion and force from the leg and foot of the float tube user to extend the fin away from the sole of the shoe and into position to create forward user motion.

The devices of U.S. Pat. No. 2,276,082 and U.S. Pat. No. 3,432,868 and the above described Paddle Pusher also compel the user of a float tube to assume a forced, generally upright vertical position to move through the water. As a consequence of such designs, much of the user's leg motion with these devices is wasted, and such awkward movement within the float tube is inherently uncomfortable and dangerous. Moreover, a forward propulsion fin device known as Float Striders (patent pending) by R.C. Enterprises, Ghent, N.Y., provides a coated fabric into which tubular ribs are sewn to stabilize the fabric in a generally planar fin-type surface. This device attaches loosely downwardly and behind the heel of the user's foot, being secured to the user's boot by woven straps and buckles. In walking to enter and exit the water, the fin surface of this device drags on the ground behind the user's foot, thereby creating a danger of tripping and falling if the user of the device were to be in a rearward, off-balance position. In use in the water, this fin device loosely depends downwardly from its attaching straps. Consequently, the device is inefficient in that it is not biased in an operating position other than by the forces of gravity. Moreover, many users of float tube fins do not wear boots, preferring to eliminate the weight of the boot by using only "stocking foot" waders. If used over stocking foot waders, the Float Strider device tends to slip off the foot since there is no protruding boot heel about which the fin and its webbing straps are retained.

The devices of my above-incorporated U.S. Pat. No. 5,531,621 and U.S. Pat. No. 5,645,460 overcome many of the objections to the prior art devices raised above. However, the hinging arrangement and means of extending the fins of these inventions can sometimes be a little awkward when moving them from a closed to an operative position. Both devices are also rather complicated. The devices of my above related and incorporated U.S. Pat. No. 5,593,333, improves the ease by which a user can move the fin assembly device from its reset position for minimum water resistance to its operative position for paddling or to its fixed position for walking in shallow water. However, the hinging mechanism and bias structure for this device are heavy and somewhat expensive to manufacture. Maintaining free movement of the hinging mechanism also requires special lubricant impregnated bushings, while salt-water use presents a corrosion problem due to electrolytic activity of dissimilar metals generally used in the spring and hinge. Consequently, there is still a need for a fin assembly for use by float tube users which is efficient to use, easy to walk on, easy to wear when donning a float tube, and simple and inexpensive to manufacture.

SUMMARY OF THE INVENTION

Accordingly, it is one object of the present invention to provide an improved forward propelling float tube fin that is lighter and more efficient in use by reducing the effort required to overcome the inertia of a heavier fin assembly in a to and fro kicking movement.

It is another object of the present invention to provide a forward float tube fin assembly of greater efficiency having fewer moving parts and requiring less maintenance.

A further object of the present invention is to provide enhanced safety when using a float tube fin assembly by reducing the danger of slipping and falling while walking and wearing the device, thus enabling the user of the fin assembly to negotiate steeply sloped banks which are frequently encountered when walking in marginal waters and near shore.

An additional object of the present invention is to provide a safety release mechanism to free a float tube user from a mired down or entangled fin assembly which otherwise might cause drowning or other injury to the user.

Yet another object of the present invention is to provide a fin assembly which is of more durable construction while using fewer metallic fastenings and parts subject to corrosion.

Still another object of the present invention is to provide a simpler, less complex and less costly fin assembly which enables a float tube user to propel himself forwardly in the water in the direction which the user faces as well as to walk forwardly in a stable manner on land and in shallow water.

To achieve the foregoing and other objects and in accordance with the purpose of the present invention, as embodied and broadly described herein, a fin assembly for attachment to the foot covering of a float tube user is disclosed, the foot covering having a sole, a toe portion and a heel portion. The assembly includes a base member having a front portion, a rear portion, an upper surface and a lower surface. A mechanism is provided for releasably attaching the upper surface of the base member to the sole of the foot covering. A fin member is provided and has a front end portion, a rear end portion, a top surface and a bottom surface. A hinge apparatus mounts the front end portion of the fin member to the front portion of the base member so that the fin member is pivotally movable between a retracted position wherein the fin member top surface is positioned proximate the base member lower surface, and a base operational position wherein the fin member rear end portion projects at an angle below the base member lower surface. A device selectively secures the fin member in its retracted position, and another device selectively secures the fin member in its base operational position. A mechanism is provided to enable the fin member, when secured in its base operational position, to vary between a first fully extended operating position wherein the fin member rear end portion is fully extended to maximize resistance to flow of water against the fin member top surface as the fin member is moved in a rearward direction relative to the user for propelling the user forwardly in the water, and a second return operating position wherein the fin member rear portion is feathered rearwardly and upwardly toward the base member lower surface to provide substantially reduced resistance to flow of water across the fin member bottom surface as the fin member is moved in a forward direction relative to the user. Finally, a mechanism is provided to limit the maximum angle between said fin member in its first fully extended operating position and the plane of the base member lower surface.

BRIEF DESCRIPTION OF THE DRAWINGS

The accompanying drawings which are incorporated in and form a part of the specification illustrate preferred embodiments of the present invention and, together with a description, serve to explain the principles of the invention. In the drawings:

FIG. 1 is a side perspective view illustrating one fin assembly embodiment constructed in accordance with the present invention in position on the foot of a user while in a float tube and in operational position;

FIG. 2 is a side perspective view of the fin assembly of the present invention mounted to the boot foot wader foot of a user illustrating the fin assembly of the invention in its retracted position for walking;

FIG. 7 is a plan view of the underside bottom surface of the fin member component of the fin assembly of the invention particularly illustrating the positioning and spacing of a typical traction mechanism useful with the invention;

FIG. 8 is a cross-sectional view taken substantially along line 8—8 of FIG. 7;

FIG. 9 is a cross-sectional view taken substantially along line 9—9 of FIG. 7;

FIG. 17 is an exploded, partial front perspective view of one embodiment of the base operating position locking and hinging mechanism of the fin assembly of the present invention;

FIG. 18 is an enlarged, cross-sectional view of an alternate embodiment of the connection portion of a fin member attack angle limiting element to the fin member of invention;

DETAILED DESCRIPTION OF THE PREFERRED EMBODIMENTS

Figure 3:
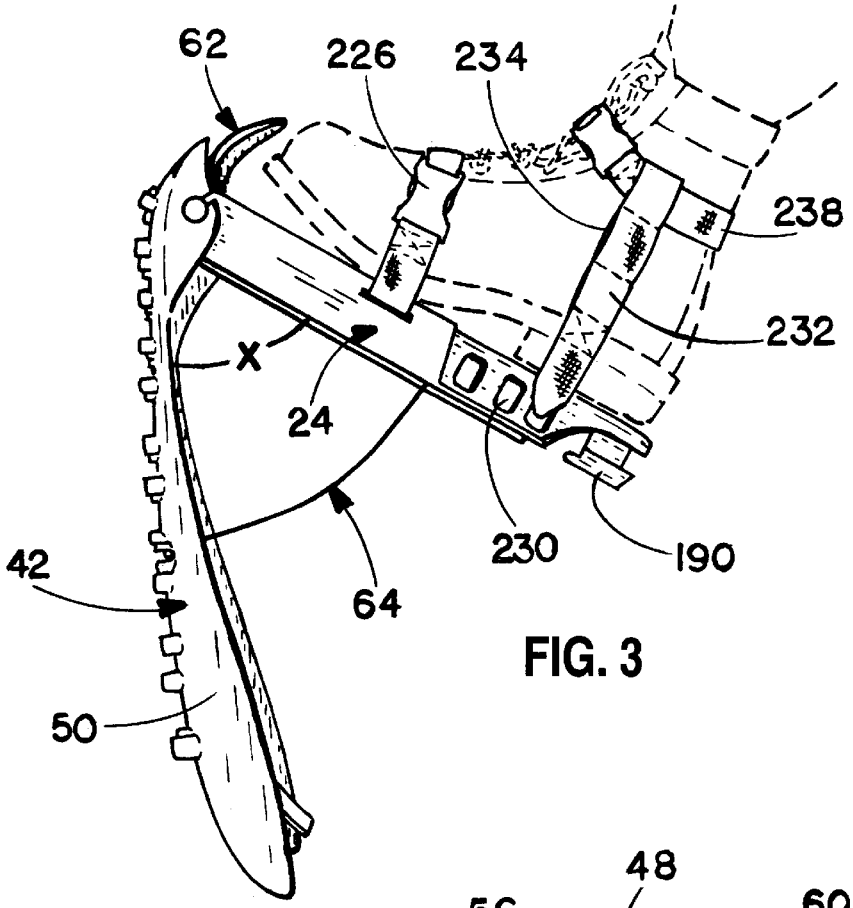
FIG. 3 is a side perspective view of the fin assembly of the present invention mounted to a wading boot such as can be worn over stocking foot type waders and particularly illustrating the fin member extended in its base operating position.
Figure 4:
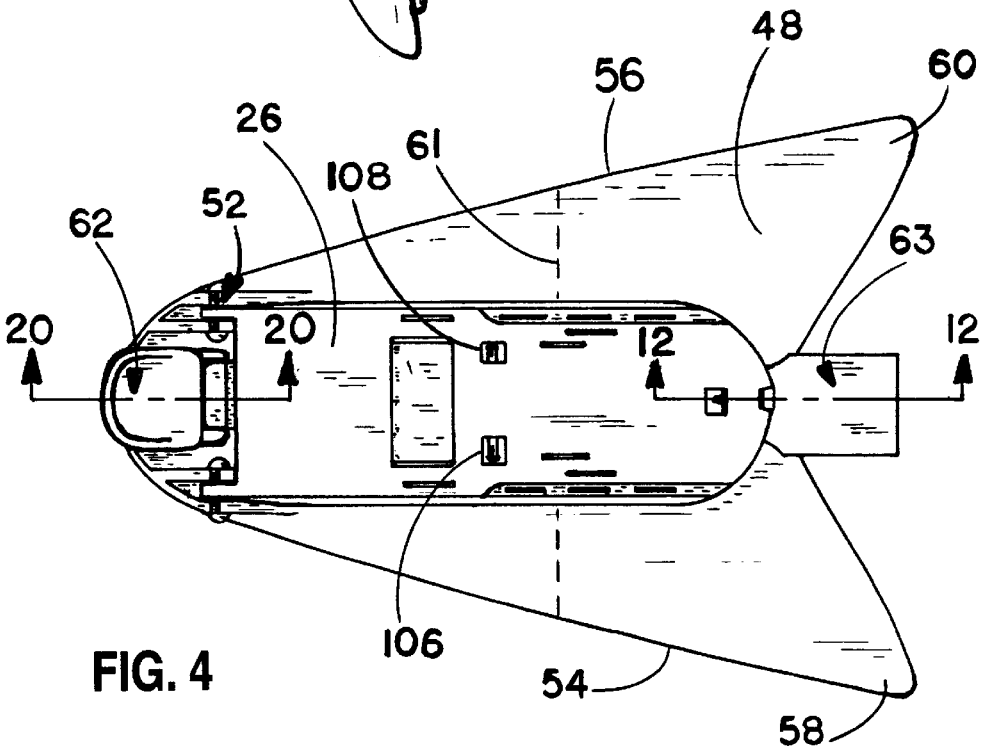
FIG. 4 is a top plan view of the fin assembly of the present invention with the fin member attack angle limiting element and base member attachment mechanism being omitted.

Referring first to FIG. 1, paired left and right fin assemblies 10, 12 are illustrated mounted on the feet 14 of a float tube user 16 resting in a typical float tube 17. The fin assembly 10 is shown in its fully extended operating position, while the fin assembly 12 is shown in its feathered return operating position. As can be seen, the rearward and forward kicking motion of the fin assemblies 10, 12 indicated by the arrows 18, 20, respectively, operate to propel the user 16 in a forwardly direction 22 on the water. The principal components of fin assemblies 10, 12 of the present invention are constructed primarily of molded semi-rigid and flexible plastic material, although other strong lightweight and corrosion resistant materials such as aluminum can be utilized integral with plastic materials, or as a substitute for the plastic material in some parts of the fin assembly. It should be understood that in the present specification and drawings where only one fin assembly or sub-assembly is described in detail, there are paired left and right fins and sub-assemblies which are constructed and operate in substantially identical fashion.

Referring now to FIGS. 1–6, a fin assembly 10 of the present invention preferably includes a base member 24 having an upper surface base plate 26 sized for receiving the boot or foot 14 of a user 16. The base member 24 also includes a front portion 28, a rear portion 30 and a lower surface 32. The front portion 28 and rear portion 30 are secured, respectively, to the toe 34 and heel 36 of a foot or boot 14 by an attachment mechanism 38. The foot or boot 14 also includes an ankle portion 40 which is secured to the base member 24 by the attachment mechanism 38 as described in greater detail below. In preferred form, the fin assembly 10 includes a fin member 42 having a front portion 44, a rear portion 46, a top surface 48 and a bottom surface 50. The front portion 44 of fin member 42 is pivotally secured to the front portion 28 of the base member 24 by a hinge mechanism 52 as described in greater detail below. As more clearly illustrated in FIGS. 8 and 9, the broad upper surface 48 of the fin member 42 includes a pair of side edges 54, 56 which diverge outwardly from each other from the fin member front portion 44 toward the fin member rear portion 46 and terminate in tips 58, 60. In this manner, the width dimension of the rear portion 46 is substantially greater than the width dimension of the front portion 44 of the fin member 42. This shape is generally typical of swim fins or flippers.

As can be seen from FIGS. 2 and 3–5, the fin assembly 10 of the present invention has several positions of operation. The fin assembly 10 is movable between a retracted position (FIG. 2) adapted to enable the user 16 to walk on a surface, and a base operating position (FIG. 3) wherein the fin member 42 is locked into a predetermined angle X relative to the base member 24 by a front locking or securing mechanism 62 as described in greater detail below. A second rear locking or securing mechanism 63 as described below is provided to maintain the fin assembly 10 in its retracted position for user walking. From its base operating position (FIG. 3), the fin member 42 may be placed into a fully extended operating position (FIG. 5) wherein said fin member rear end portion 46, along with its side edges 54, 56 and tips 58, 60, is fully extended to maximize resistance to flow of water against said fin member top surface 48 as said fin member 42 is moved in a rearward direction 18 relative to the user 16 for propelling the user 16 forwardly in the water. The fin member 42 may also be placed into a second return operating position (FIG. 6) wherein the fin member rear portion 46 along with its side edges 54, 56 and tips 58, 60, is feathered rearwardly and upwardly toward said base member lower surface 32 to provide substantially reduced resistance to flow of water across said fin member bottom surface 50 as said fin member 42 is moved in a forward direction 20 relative to said user 16.

Figure 5:
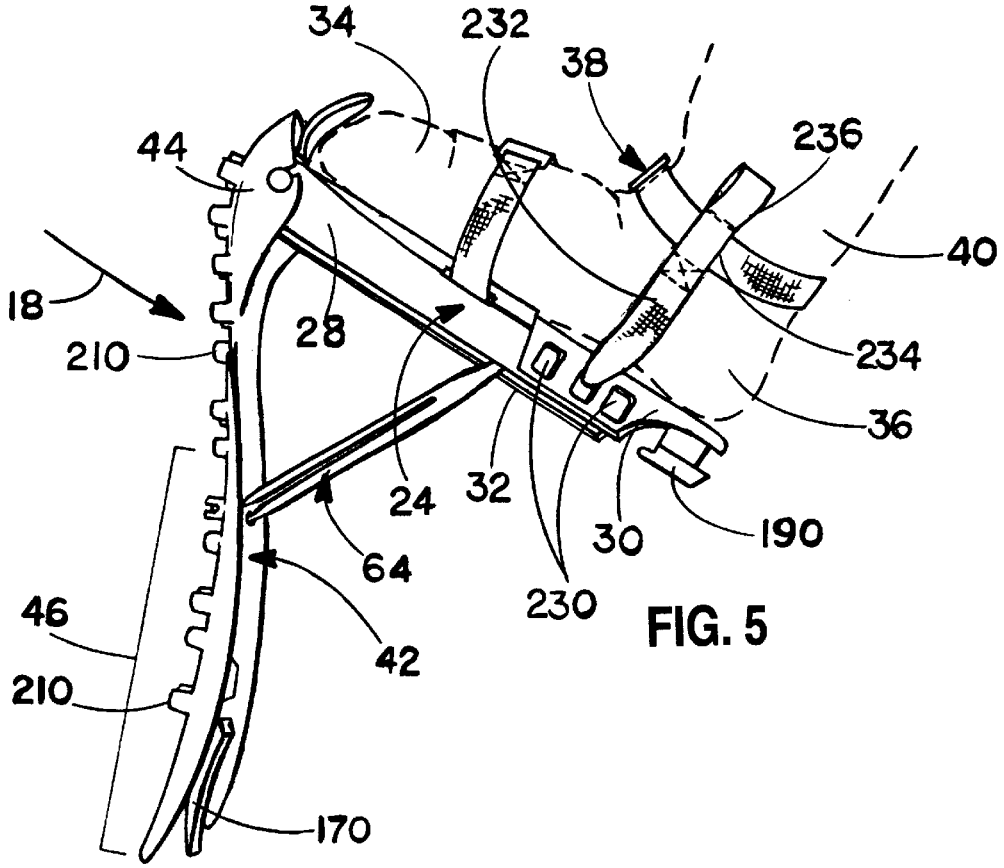
FIG. 5 is a side perspective view illustrating a fin assembly constructed in accordance with the present invention as mounted on the stocking foot wader foot of a float tube user and locked into its base operating position while illustrating the fin assembly in its fully extended operating position in a power kick toward the rear of the user.

Referring to FIGS. 1–9, the front portion 44 of the fin member 42 is formed in a generally flat planar configuration while the fin tips 58, 60 and the bottom surface 50 of the fin member rear portion 46 are preferably slightly curved upwardly toward the base member 24 in a scooped fashion. In this manner, the fin member rear portion 46 may easily flex from the base operating position as shown in FIG. 3 into both a first fully extended operating position as illustrated in FIG. 5 in which greater water resistance is created when the fin assembly 10 is moved in a rearwardly direction, the power stroke, as indicated by the arrow 18, and a second feathered return operating position in which the fin assembly 10 offers reduced water resistance when it is moved in a forwardly direction, the reset stroke, as indicated by an arrow 20. In an alternate embodiment, a fold along line 61 may be used to assist in the movement of the rear portion 46 between the fully extended operating position and the return operating position.

In FIG. 5, the fin assembly 10 is illustrated in its fully extended operating position in a power kick to the rear as indicated by the arrow 18. In this position, the rear fin tips 58, 60 are broadly deflected outward, and the rear portion 46 of the fin member 42 is flexed forward with the greatest flexure originating at and being generally to the rear of the attachment of retaining check strap or cord 64 to the fin member 42. The check cord 64 is an interconnecting member between the base member 24 and the fin member 42 which, together with the hinge assembly 52 and the locking mechanism 62, transfers the force generated in a power kick from the foot 14 of the user 16 to the fin member 42. Moreover, the check cord 64 serves as a stop member limiting the angle "X" shown in FIG. 3 and preventing overextension between the base member 24 and the fin member front portion 44 when the fin assembly is in its base operating position.

In one preferred form of the invention as illustrated in FIGS. 13–16, the check cord 64 is a flexible strap member 66 having a pair of upper connecting arm portions 68, 70 which terminate respectively in button openings 72, 74. In addition, a pair of lower connecting arm portions 76, 78 are provided and terminate in T-connectors 80, 82. In preferred form, the strap member 66 is flexible plastic. A T-shaped connecting element 84 having end posts 86, 88 depends from the lower surface 32 of the base member 24 and provides a means for attachment for the strap 66. In this embodiment, the button openings 72, 74 of the strap 66 are snugly secured over the end posts 86, 88, respectively. In addition, slots 90, 92 are provided in the fin member 42 for attachment to the T-connectors 80, 82 of the connecting arm portions 76, 78. In preferred form, the bottom surface 50 of the fin member 24 includes a modified cleat element 94 depending from immediately below each slot 90, 92, and each cleat element 94 includes a pocket 96 and a pair of opposed notches 98, 100 in the side edges thereof. In this manner, the lower connecting arm portions 76, 78 with their T-connectors 80, 82 may be firmly set into place by, for example, inserting the T-connector 80 into the slot 90, rotating it 90°, and then snugly setting it into the pocket 96 and the notches 98, 100. This is repeated for the T-connector 82 and the slot 92.

Figure 6:
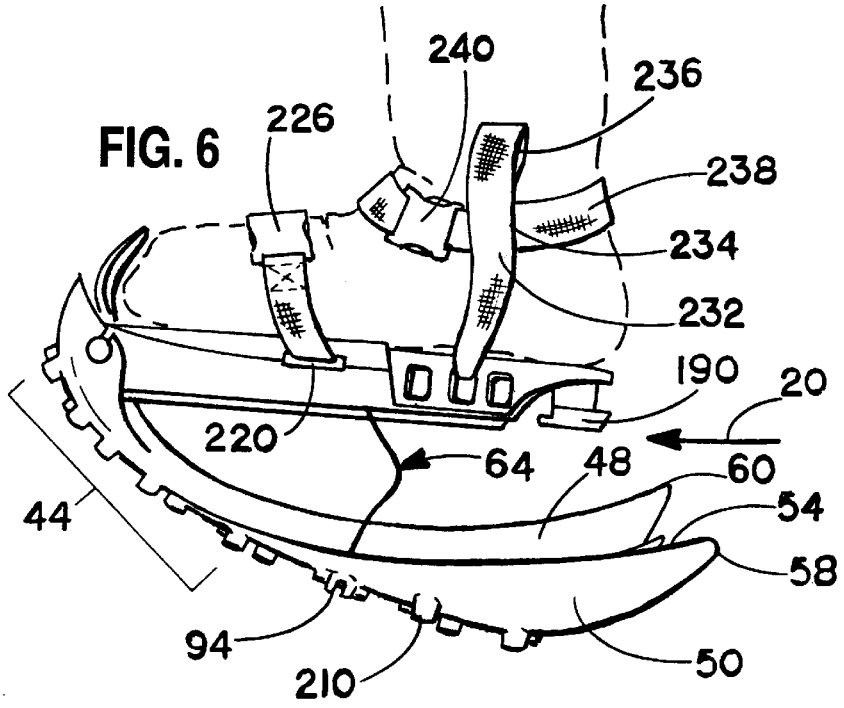
FIG. 6; is a side perspective view illustrating a fin assembly constructed in accordance with the present invention as mounted on the stocking foot wader foot of a float tube user and locked into its base operating position similar to that of FIG. 5 but illustrating the fin assembly feathered in its return operating position in a reset kick to the front of the user.

An alternate embodiment for the check cord 64 is illustrated in FIGS. 3, 6 and 18. In this alternate embodiment, the check cord 64 is preferably a reinforced cord 102 commonly known as parachute cord, strong woven webbing, or other suitably strong and flexible material, including formed plastic members secured to both the base member and the fin member by known methods such as sewing, rivets, clamps, etc. In this embodiment, a knotted terminal end 104 of check cord 102 seats in a recess 96 formed in a check cord cleat 94 which is formed integral with the lower surface 50 of fin member 42 as described in the prior embodiment. The bottom surface of check cord cleat 94 is formed as a thicker extension of the fin member to reinforce the connection of the check cord 102 to the fin member 42. The free end of check cord 102, having passed through an aperture or slot 90 through check cord cleat 94 and the upper surface 48 of fin member 42, passes through apertures 106, 108 in the side edges 110, 112 of the base member 24 and thence through aperture 92 formed through the fin member 42 and right check cord cleat 94. A knot 104 is tied in the free terminal end of check cord 102 so that it also seats in the recess 96 of check cord cleat 94 beneath the slot opening 92, thus completing the interconnection of fin member 42 to the base member 24 by the check cord 102. In the base operating position as shown in FIG. 3, the check cord 64 is slightly slack when the locking mechanism 62 is fully engaged. This allows the locking mechanism 62 to slightly overrun its catch, as described below, to ensure a positive engagement of the members. If the check cord 64 were completely taut at the time of engaging the locking mechanism 62, there could be instances in which the mechanism 62 would not completely engaged. It should be also noted both embodiments of the check strap 64, that is the strap 66 and the cord 102, may be used with the same device. One example would be where the strap 66 breaks or is lost, the cord 102 can be readily attached to permit complete operation of the device 10.

One embodiment of the hinge mechanism 52 is illustrated in FIG. 17. In this embodiment, the hinge mechanism 52 pivotally interconnects the front portion 28 of the base member 24 and the front portion 44 of the fin member 42. In this embodiment, a pair of raised hinge flanges 114, 116 are formed on the front portion 44 of the fin member 42. A hinge pin 118, which may be in the form of a bolt, rivet, or any other known pin member, functions as the central pivotal structure of the hinge mechanism. The pin 118 passes through apertures 120, 122 in the hinge flanges 114, 116 of the fin member 42 and through apertures 124, in the curved front end portion 28 of the side edges 130, 132 of the base member 24. The hinge pin 118 is preferably permanently installed in known fashion, either as a snap fit plastic member, or in the case of an aluminum or other malleable metal, rivet headed or secured in other known fashion. However, the pin 118 may also be removable. Angle "X" shown in FIG. 3 between the base member 24 and the fin member 42 in its base operating position is maintained by the front locking mechanism 62 located on the front of the fin assembly 10, formed integrally with the members of the hinge mechanism 62 in this particular embodiment.

The front locking mechanism 62 in this embodiment is in the form of a latch mechanism 125 and includes a pawl 126 located on a base operating position latch arm 134 which is formed as an integral part of the front portion 44 of fin member 42, and a catch 136 located on the front portion 28 of the base member 24. This latch mechanism 125 is biased by internal resistance or memory of the material from which it is constructed to remain normally in position for the pawl 126 to engage the catch 136. In releasing the latch mechanism 125, pressure is applied against the latch arm 134 by the user's opposite foot, aided by cleats 138 formed on the underneath portion or surface 50 of the fin member 42 to flex the latch arm 134. This action allows the pawl 126 to withdraw from catch 136 to release the fin member 42 from its base operating position as discussed below. Both the length of check cord 64 and the interrelationship of the positioning of the latch pawl 126 and the catch 136 will vary depending on the flexibility of the material used in fin member 42 and the seated posture of a user of the fin assembly 10. For example, the optimum angle "X" will be greater for use in a pontoon boat due to the higher seated posture above the water in which the user's legs depend more vertically than the legs of a float tube user, which extend more horizontally forward. In preferred form, the angle "X" is less than 90° and is preferably an acute angle ranging generally between 60–75° and more preferably from 60–70° for float tube use. It should be understood, however, that the predetermined angle "X" is be dependent on the type of material selected for use in the fin member 42, the cross-section configuration of the fin member 42, the stiffness of the fin member 42, and the particular type of float used by the user 16. A second catch member 137 illustrated in FIG. 20 can be formed to define the optimum fin angle "X" for pontoon boat use, in which case a longer check cord 64 will allow the latch pawl 126 to overrun the first latch catch 136 to engage the second catch. In other simple embodiments designed for use with either float tubes or pontoon boats, a single latch catch 136 may be formed in a medial position common to the optimum fin positions for float tube and pontoon boat use.

Figure 19:
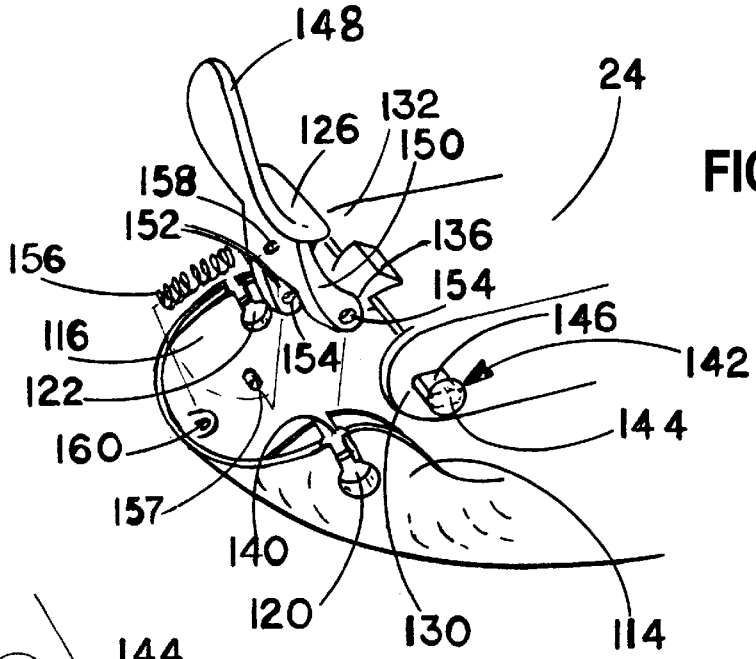
FIG. 19 is an exploded, partial front perspective view of another embodiment of the base operating position locking and hinging mechanism of the fin assembly of the present invention.
Figure 21:
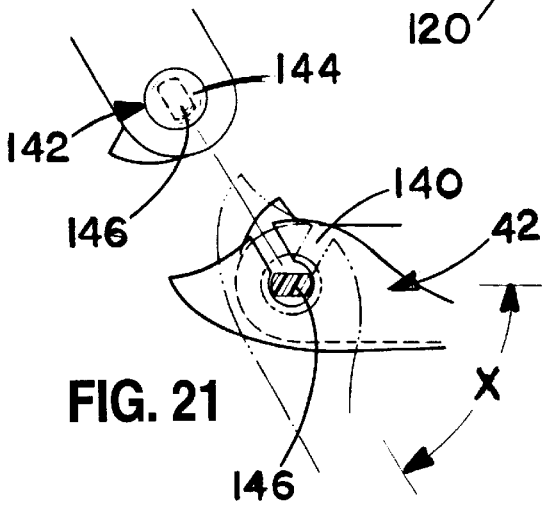
FIG. 21 is a side elevation, with parts in shadow, of the embodiment of FIG. 19 and illustrating the connection/disconnection capability between the fin member a the base member of this embodiment of the invention.

Another and preferred embodiment of the hinge mechanism 52 and front locking mechanism 62 is illustrated in FIGS. 19 and 21. In this embodiment, the front portion 48 of the fin member 42 includes a pair of hinge flanges 114, 116. Apertures 120, 122 are disposed therein. Each aperture 120, 122 includes a slot opening 140 which passes into the aperture 120, 122 and allows access therein. The base member 24 includes a front end portion 28 having side edges 130, 132. In this embodiment, each side edge 130, 132 includes a hinge pin 142 projecting outwardly therefrom and includes a head portion 144 and a stud 146 which includes opposed flat edges so that the stud 146 can slide through a slot 140 into an apertures 120, 122. In normal operation, the stud 146 rotates within the apertures 120, 122. However, when the base member 24 is rotated approximately 120° from the fin member 42 as illustrated in FIG. 21 so as to align the slot 140 with the flat surfaces of the stud 146, the fin member 42 and the base member 24 can be disconnected from each other for storage and transport.

In this embodiment, the hinge mechanism 52 includes a latch arm 148 which preferably has a pair of ears 150, 152 each of which includes an aperture 154. A pair of hinge pins 157 are integrally molded into the flanges 114, 116 and are sized for insertion into the apertures 154. In this manner, the latch arm 148 is pivotally mounted to the hinge flanges 114, 116. The latch arm 148 includes a pawl 126, and the front portion 28 of the base member 24 includes a catch 136, similar to the prior embodiment. A spring element 156 is mounted between a pin element 158 on the latch arm 148 and a recess 160 in the front portion 48 of the fin member 42. The spring element 156 urges the latch arm 158 upwardly so that the pawl 126 engages the catch 136 as in the previous embodiment. However, in this embodiment, the latch mechanism 52 is disengageable as are the fin member 42 and the base member 24.

In FIG. 6, the fin assembly 10 is shown in its fully feathered return position in a reset kick forward as shown by arrow 20. The fin member rear tips 58, 60 are flexed upward and inward, and the fin member rear portion 46 is deflected upward toward the base member 24 by the resistance of water flowing against the fin member bottom surface 50. In the feathered return position, the greatest amount of deflection from the base operating position is in the generally flat planar forward portion 44 of the fin member 42, originating at the base operating position latch mechanism 62 and hinge assembly 52 shown particularly in FIG. 6. The resistance of water on the entire bottom surface 50 of the fin member 42 is leveraged against the flexure of the fin member 24 in its front portion 44, whereas, as previously described the flexure of fin member 42 in the fully extended operating position, is greatest in the rear portion 46 of the fin member 42. This differential leveraging of the fin member 42 in its operating positions increases the overall efficiency of the fin assembly.

A protruding rear locking mechanism 63 is shown in FIGS. 4–12. In one embodiment of the rear locking mechanism particularly illustrated in FIG. 12, the latch 160 is formed integrally under the rear portion 30 of the base member 24 to firmly interlock the base member 24 and the fin member 42 together in position for walking and wading in shallow water as shown in FIG. 2. The base member latch member 160, shown in greater detail in FIG. 11, includes an alignment wedge 162 which seats in a mating alignment wedge socket 164 formed as part of a fin member rear latch mechanism 63 integral on the rear portion 46 of the top surface 48 of fin member 42. When engaged in the latched position for walking, the alignment wedge 162 and wedge socket 164 firmly interlock to resist the opposing lateral forces which occur in walking over uneven surfaces. These lateral forces would otherwise twist the base member and fin member out of alignment, straining or breaking the hinge assembly 52 and could cause the rear latch pawl 166 to disengage from catch 168, allowing the fin member 42 to flop about from the hinge assembly 52.

Figure 10:
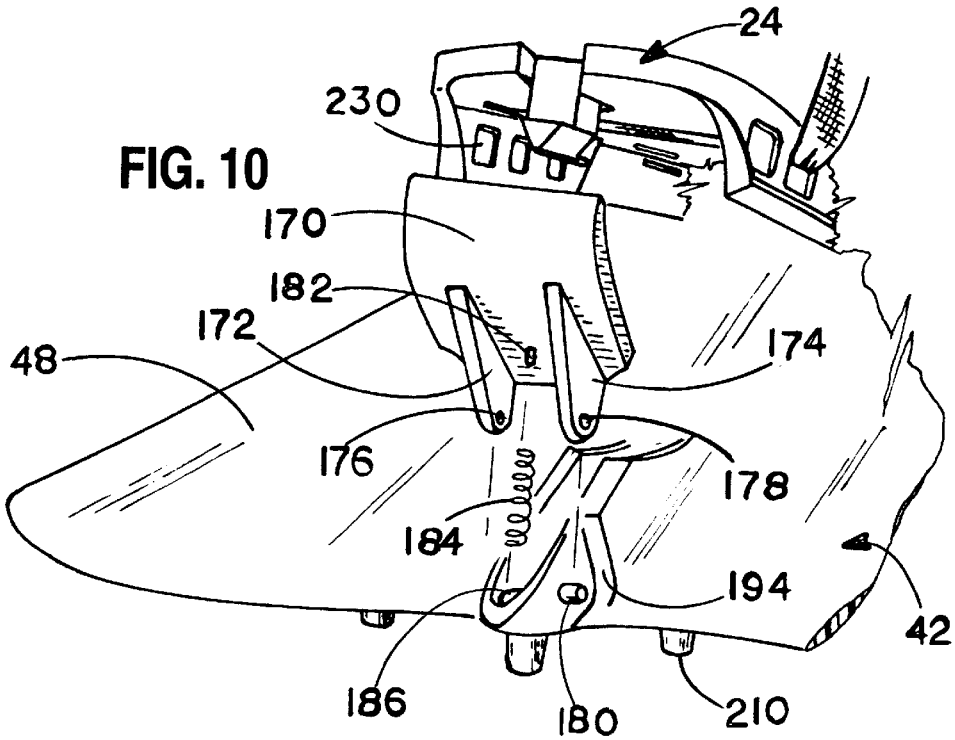
FIG. 10 is an exploded, partial rear perspective view of the fin assembly of the present invention particularly illustrating the mechanism for selectively securing the fin member of the invention in its retracted walking position.
Figure 11:
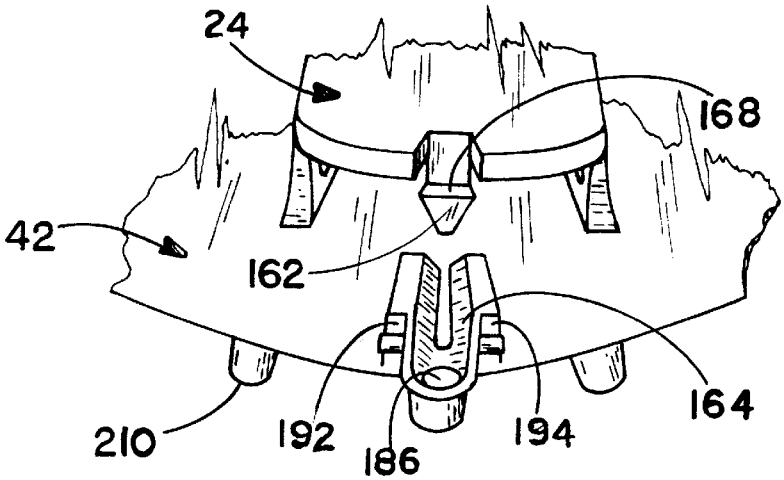
FIG. 11 is a partial rear perspective view, with parts cut away, of the fin member and base member of the fin assembly of the present invention.

Referring more in detail to the embodiment of FIG. 10, the underneath surface of the rear latch arm 170 includes an integral pair of pivot extensions 172, 174 with formed apertures 176, 178 which, in the preferred form, permanently snap fit over pivot pins 180 formed integral in the rear latch mechanism 52. A rounded cylindrical protrusion or spring keeper 182 also formed on the underneath surface of latch arm 170 has the function of preventing a spiral latch spring 184 from slipping out of the rear latch mechanism 52. When assembled, the opposite end of latch spring 184 is retained in position in a recessed spring seat 186 formed in the fin member rear latch mechanism 52. Latch spring 184 is positioned to create a bias force against the rear latch lever arm 170 so as to continuously urge the latch pawl 166 on lever arm 170 into engagement with a catch 168 located on latch member 190 on the lower surface of the base member 24. By pressing latch lever arm 170 downward with the toe of the user's opposite foot, the bias of spring 184 is overcome, and the pawl 166 disengages from the latch catch 168, allowing the fin member 42 to be extended and latched in its base operating position by continued downward pressure against latch lever arm 170. Once pressure against lever arm 170 is released, the latch member pivots forward with the forward ends of the pivot extensions 172, 174 coming to rest against stop members 192, 194 formed in the fin member rear latch mechanism 52. This positioning against the stop members 192, 194 prevents the latch from pivoting further forward which would allow the latch spring 184 to drop out of its position within the latch mechanism 52. Downward movement of latch arm 170 is limited by the rear extension of the rear latch mechanism 52. In a forward and backward kicking motion, the latch arm pivots between its two stopped positions, being feathered against the stop members 192, 194 in a forward kick, and extended against the rear extension of the rear latch mechanism 52 in a rearward kick. In this manner the latch arm 170 aids somewhat in creating a greater resistance to movement through the water in a kick to the rear to propel a user forward.

Figure 12:
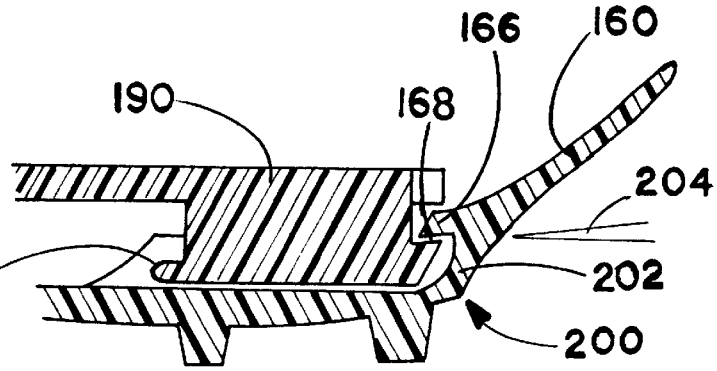
FIG. 12 is a cross-sectional view taken substantially along line 12—12 of FIG. 4.
Figure 13:
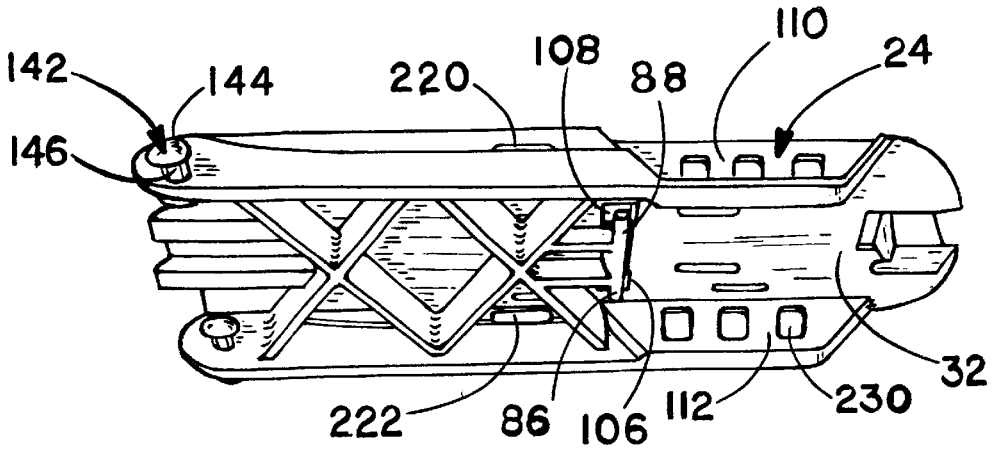
FIG. 13 is a bottom perspective view of the fin assembly base member constructed in accordance with the present invention.
Figure 14:
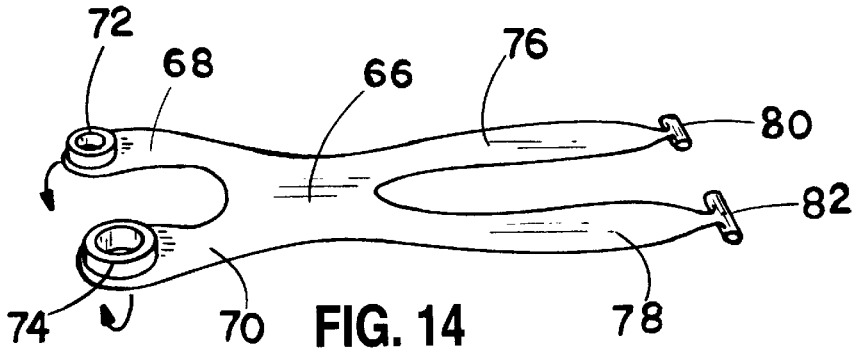
FIG. 14 is a top perspective view of one embodiment of the fin member attack angle-limiting element useful with the fin assembly of the present invention.
Figure 15:
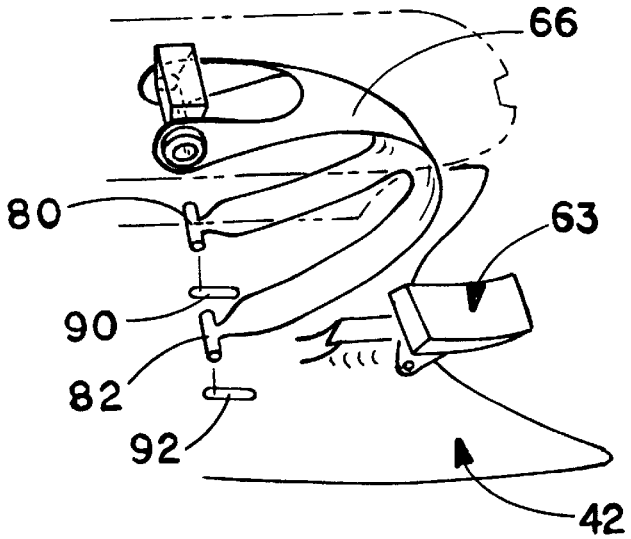
FIG. 15 is an exploded partial top perspective view, with parts cut away, of the rear portion of the fin assembly of the invention and particularly illustrating the positioning of the fin member attack angle limiting element of FIG. 14.
Figure 16:
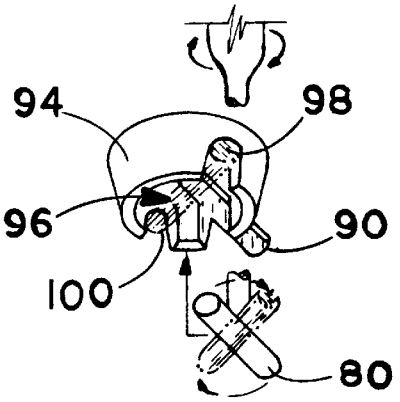
FIG. 16 is an enlarged, exploded bottom perspective view of the connection portion of the fin member attack angle limiting element of FIG. 14 to the fin member of the invention.

An alternate rear latch 200 is illustrated in cross section in FIG. 12. The alternate latch is of simpler structure, being formed integral with the rear portion 46 of the top surface 48 of the fin member 42. The alternate latch 200 operates in identical fashion to rear latch mechanism 52, except that the bias means to the latched position is by internal resistance of the formed latch material and the hinge means is a living hinge formed in a reduced portion 202 of the alternate latch 200. A negative latch catch and pawl angle 204 is indicated in FIG. 12 and is also formed in the catch and pawl of the first described latch mechanism 52. This negative angle causes the latch mechanism to grip firmly even as pulling forces against it such as those encountered in walking over sticky silt and mud surfaces increase, preventing the latch from springing open when it is desired that it remains firmly latched.

Figure 20:
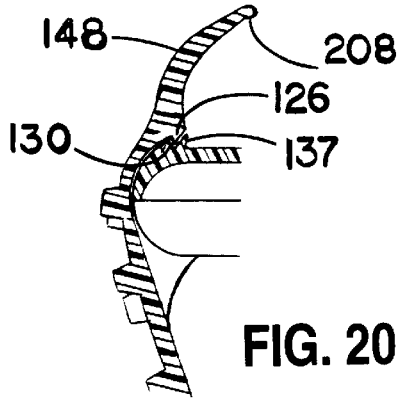
FIG. 20 is a cross-sectional view taken substantially along line 20—20 of FIG. 4.

A small protrusion 206 formed on the front portion of the interlocking rear latch member 190, shown in FIG. 12, has the function of inter-connecting with a protruding ridge 208 shown in FIG. 20, which is formed on the rear edge of the base operating position latch arm 148 to provide a firm no slip connection of the latch member 190 to the latch arm 148 when releasing the base operating position latch pawl 126 from the latch catch 130 and in rotating the fin member 42 to its latched retracted position for walking. When the first fin member 42 has been retracted and latched, the cleats 210 on the bottom surface 50 of the rear portion of that fin member interconnect with ridge 208 on latch arm 148 of the opposite foot to assist in releasing the latch pawl 126 from the catch 130 to retract the fin member of the opposite foot in like manner.

In FIGS. 5–12, spaced apart traction cleats 210 are formed integral on the bottom surface 50 of fin member 42 to aid in walking over rocky and slippery surfaces. Alternately felt soles similar to those commonly used on the under surface of wading boots with holes appropriately sized and spaced to fit around the cleats 210 may be removably affixed in known fashion such as snaps, screws or bolts on the walking surface of fin member 42. In other versions of the fin assembly 10, cleats can be omitted from the fin member with felt soles cemented or otherwise permanently affixed in known fashion to the walking surface of the fin member. In still other alternate versions, raised letters and or graphic designs in mirror image can replace some or all of the cleats, with the letters or designs functioning to provide traction, while also impressing a trademark or other message into soft surfaces which users walk upon.

As previously indicated, the base member 24 is secured to the foot 14 of the user 16 by an attachment mechanism 38. In one embodiment of the present invention as illustrated in FIGS. 2–6 and 22, a pair of slots 220, 222 are disposed in the side edges of the base member 24 toward the forward portion 28 thereof. The slots 220, 222 are preferably aligned below the upper surface base plate 26. A strap 224 passes through slots 220, 222 and has its ends interconnected at a connecting member 226. The connecting member 226 preferably is a commonly used side release buckle or other similar separating device which provides an easily adjustable and releasable, yet secure connection. A second connection device 228, such as a commonly known tri-glide fastener, is shown used in combination with connecting member 226 to secure the loose end of strap 224 after a length adjustment is made at connecting member 226, although other means may be used to secure the free end of the strap 224 to assure that the adjustment at connecting member 226 remains fixed. In either event the strap 224 is fixedly adjustable at the connecting member 226 so as to firmly hold the toe 34 against the base plate 26.

In similar manner, a plurality of slots or openings 230 are positioned in the side edges at the rear portion 30 of the base member 24 and aligned below the base plate 26. A second strap 232 passes through selected slots 230 so as to move upward along both sides of the foot 14 toward the ankle portion 40. The strap 232 preferably includes a first pair of connection openings 234 and a second set of connection openings 236 that are the terminal ends thereof. An ankle strap 238 surrounds the ankle portion 40 of the foot 14 and passes through the first set of openings 234 or the second set of openings 236. The ends of the ankle strap 238 are adjustably connected by a connection member 240 which is similar to the connection member 226 except that in preferred form the connection member 240 is designed as a safety release mechanism to separate at a predetermined pull, releasing the user's foot 14 from the fin assembly 10 in the event that the fin member 42 became mired down in quicksand, heavy silt or the like, or entangled in debris in such a fashion as to trap and endanger the user to drowning or other hazard.

Figure 22:
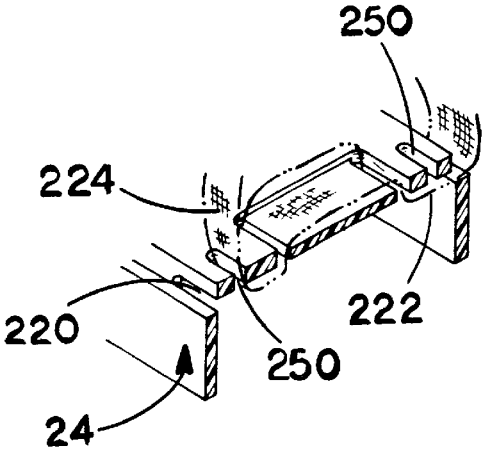
FIG. 22 is an enlarged, partial cut-away view of the base member of the present invention illustrating the positioning alternatives thereon for the boot attachment mechanism of the present invention.

The safety release mechanism of connection member 240 can be designed integral in the portions which connect with the straps in any known fashion to break or separate at a pre-determined pull in excess of that experienced in normal use, similar in fashion to the safety release mechanisms of many downhill ski pole straps. With the ankle strap thus released, the user's toe 34 would easily slip out of the first strap 224, without the need for a break away connecting member on strap 224, although optionally both strap connecting members 226, 240 can be provided as safety release members. Ankle strap 238 should be positioned as low as possible on the users ankle 40 to firmly hold the heel 36 against the base plate to assist in transferring forces between the fin member 24 and the foot 14 of the user 16. Therefore, ankle strap 238 preferably passes through the lowest set of openings 234 in the upward strap 232. When attaching the fin assembly 10 over boots, their larger configuration and size will usually necessitate positioning strap 238 in the upper connection openings 236. In FIG. 22, optional additional slots 250 are shown passing through the base plate upper surface 26 to allow alternate positioning of strap 224 for a more secure fastening of smaller boots or feet, and to adjust the alignment of the fin assembly to the orientation of the user's feet.

In attaching the fin assembly 10 to a user's foot 14, the fin member 42 is positioned in the latched retracted position for walking as illustrated in FIG. 2. In this position it is relatively easy to adjust the length and secure the attachment straps to the users foot. Once the adjustment is correct and the ends of the straps are made secure by the second connection member, it is usually unnecessary to readjust the length of the straps. Consequently, when the fins are attached in future uses, the ends of the connection members are simply snapped together. Upon having attached the fin assemblies to the feet of the user, he or she then dons the float tube as described previously above, except that with the fin member 24 retracted under the foot and not extending out in front as with prior fins, it is quite easy to step over and into the tube. The tube is next picked up and held in both hands by the webbing handles which are normally provided sewn into the top surface of the tube and the user then walks forward carrying the tube to enter the water.

When the user is floating in the tube, he or she then uses the toe of one foot to press downward against the latch arm 170 of the opposite fin to release the rear latch mechanism 52 and by continued downward pressure rotates the fin member 24 to engage the base operating position latch mechanism. Alternately, it is possible to simply release the rear latch mechanism and then engage the base operating position latch mechanism by kicking to the rear, in which movement the resistance of water on the upper surface of fin member will rotate the fin member forward, engaging the base operating position latch. The second fin is released from its latched retracted walking position and latched in the base operating position in like manner.

Use of the fins in the water is as one would instinctively function. Kicking to move forward in the water is a diagonal forward and backward motion similar to normal foot movement in walking. During this movement the fin member automatically flexes from the base operating position to both a feathered return position offering minimum resistance to water against its lower surface in a forward kick, and a fully extended operating position in a rearward kick in which the sides and tips of the fin member are broadly flexed outward and the rear portion of the fin member is flexed forward against the limit of check cord. In this position the fin member offers maximum resistance to water against the fin members upper surface to move the user forward in the water. The natural resiliency and bias of the fin causes it to return from both the extended and feathered operating positions to the base operating position, eliminating the need for the relatively complicated hinge, bushings and spring mechanism of certain prior art mechanisms. Kicking to one side or the other rotates the user in a direction opposite the direction of the kick in a motion similar to normal pivotal or sideways movement in walking.

When coming to shore to exit the water, the user kicks forward until the fin members contact the bottom surface at which time the user releases the base operating position latch mechanism of the first fin by pressing with the opposite foot against the base operating position latch arm, also engaging the retracted position latch mechanism by continued pressure against the base operating position latch arm. The second fin is released from the base operating position and latched in its retracted position in like manner. With both fins thus retracted, the user then stands, picks up the tube in both hands, reversing the entry procedure described previously, and walks forward out of the water. Alternately, on steeply sloped banks it is possible to navigate backward with both fins latched in the retracted position to maneuver and back into shallow water, thus placing the user's center of gravity in shallower water to arise, and then to side step up banks that would otherwise be too steep to negotiate forward.

As can be seen from the above, the present invention is an improved float tube fin based on the general forward movement concepts of referenced U.S. Pat. No. 5,593,333, but of simpler, lighter, more economical design while providing greater safety and offering significant advantages to the user. The fin member of the present invention eliminates prior complex and heavy mechanisms, automatically flexing from a base operating position to either a fully extended operating position or a feathered return position in response to water pressure against its broad surfaces in a forward and backward kicking motion. Moreover, greater safety is provided for a user walking over uneven and slippery surfaces and in negotiating otherwise inaccessible steeply sloped banks due to a traction mechanism on the fin member walking surface and an interlocking fin assembly member which firmly secures the base member and fin member together when the fin assembly is latched in its retracted position. The danger of drowning or other injury resulting from a user being entrapped by mired down or entangled fins is greatly reduced by safety break away binding connections of the present invention. The fin member of the present invention can easily be selectively positioned in a retracted position for walking forward, or in an extended base operating position for use in propelling forward in the water. Finally, the fin assembly of the present invention is easily adapted for use with a wide range of sizes and types of footgear.

Although the description above contains many specifics, these should not be construed as limiting the scope of the invention but as merely providing illustrations of some of the presently preferred embodiments of this invention. For example, the fin member of the invention can have other shapes such as irregular, simulating the footprint of a web footed animal or bird, oval, triangular, trapezoidal, and the like. Further, in the case of pontoon boats and other tube designs used in floating or drift fishing streams in which it is desirable to face downstream while paddling upstream, backwards to the direction one faces while drifting, the hinging and positioning of the fin member in relation to the base member and toe and heel of the user's foot can be essentially reversed, propelling the user in a backward direction and still be within the teachings and claims of the present invention.

For brevity and to avoid confusion in the preceding specification and the following claims, where there is reference to the boot or foot of a float tube user, that reference shall be understood to also include the foot and all other footgear normally worn on the foot of a float tube user, such as a wading boot, tennis shoe, wader and stocking foot wader in addition to other descriptions. Reference to a float tube shall also be understood to include pontoon boats and other float devices commonly used in fishing, duck hunting and other aquatic activities and pursuits.

The foregoing description and the illustrative embodiments of the present invention have been described in detail in varying modifications and alternate embodiments. It should be understood, however, that the foregoing description of the present invention is exemplary only, and that the scope of the present invention is to be limited to the claims as interpreted in view of the prior art. Moreover, the invention illustratively disclosed herein suitably may be practiced in the absence of any element which is not specifically disclosed herein.

I claim:

1. A fin assembly for attachment to the foot or covering therefor of a float tube user with said foot or covering having a sole, a toe portion and a heel portion, said assembly comprising:

a base member having a front portion, a rear portion, an upper surface and a lower surface;

a mechanism for releasably attaching the upper surface of said base member to said sole;

a fin member having a front end portion, a rear end portion, a top surface and a bottom surface;

hinge apparatus for mounting the front end portion of said fin member to the front portion of said base member so that said fin member is pivotally movable between a retracted position wherein said fin member top surface is positioned proximate said base member lower surface, and a base operational position wherein said fin member rear end portion projects at an angle below said base member lower surface;

a device for selectively securing said fin member in said retracted position;

a device for selectively securing said fin member in said base operational position;

mechanism for enabling said fin member, when secured in its base operational position, to vary between a first fully extended operating position wherein said fin member rear end portion is fully extended to maximize resistance to flow of water against said fin member top surface as said fin member is moved in a rearward direction relative to the user for propelling the user forwardly in the water, and a second return operating position wherein said fin member rear portion is feathered rearwardly and upwardly toward said base member lower surface to provide substantially reduced resistance to flow of water across said fin member bottom surface as said fin member is moved in a forward direction relative to said user; and a mechanism for limiting the maximum angle between said fin member in said first fully extended operating position and the plane of said base member lower surface.

2. The fin assembly as claimed in claim 1, wherein the angle at which said fin member front end portion projects below said base member lower surface is a fixed predetermined angle, and wherein the angle at which said fin member rear end portion projects below said base member is increased from said predetermined angle when said fin member is moved to said first fully extended operating position and decreased when said fin member is moved to said second return operating position.

3. The fin assembly as claimed in claim 2, wherein said fixed predetermined angle is in the range of 60°–70°.

4. The fin assembly as claimed in claim 1, wherein said mechanism for varying said fin member between said first and second operating positions when secured in said base operational position comprises a pliable fin member capable of flexing in response to water pressure against said fin member top and bottom surfaces.

5. The fin assembly as claimed in claim 1, wherein said mechanism for varying said fin member between said first and second operating positions when secured in said base operational position comprises a fold intermediate said fin member front and rear portions adapted to move said fin member rear portion in response to water pressure against said fin member top and bottom surfaces.

6. The fin assembly as claimed in claim 1, wherein said fin assembly further comprises a traction mechanism disposed along the bottom surface of said fin member.

7. The fin assembly as claimed in claim 1, wherein said device for releasably attaching the upper surface of said base member to the sole of a foot covering comprises adjustable strap members having breakaway connection elements as safety releases.

8. The fin assembly as claimed in claim 1, wherein said device for selectively securing said fin member in said retracted position comprises a latch mechanism interconnecting the rear end portion of said fin member and the rear portion of said base member and including a latch arm terminating at one end thereof in a pawl, and a catch member adapted for releasable engagement with said pawl.

9. The fin assembly as claimed in claim 8, wherein said latch arm is secured to said fin member rear end portion, and said catch member is secured to said base member rear portion, said latch mechanism further comprising a spring bias element engaged with said latch arm adapted to urge said latch arm into engagement with said catch member.

10. The fin assembly as claimed in claim 1, wherein said device for selectively securing said fin member in said base operational position comprises a lever mechanism, and a catch member adapted to lock said lever mechanism and maintain said fin member in said base operational position, said lever mechanism including a spring bias element adapted to urge said lever mechanism toward said catch member.

11. The fin assembly as claimed in claim 10, wherein said lever mechanism comprises a lever member having a pawl thereon and adapted for pivotal engagement with said fin member front end portion, a catch disposed on said base member front portion for selective engagement with said pawl, and a spring bias element interengaging said lever member and said fin member, said lever member being movable against the bias of said spring element to selectively disengage said pawl from said catch.

12. The fin assembly as claimed in claim 1, wherein said hinge apparatus comprises a pair of spaced flanges disposed in the front end portion of said fin member each having an aperture therein, a pivot shoulder disposed at the front portion of said base member, and a hinge pin mechanism adapted for removable positioning within said flange apertures and said pivot shoulder.

13. The fin assembly as claimed in claim 12, wherein said base member pivot shoulder includes an opening therein, and said hinge pin mechanism comprises a removable hinge pin adapted for attachment through said flange apertures and said pivot shoulder opening to join said base member front portion and said fin member front end portion in a pivotal manner.

14. The fin assembly as claimed in claim 12, wherein said base member pivot shoulder includes a pair of ledges, and wherein said hinge pin mechanism comprises a pin projecting outwardly from each said ledge, each said pin being adapted for insertion into an adjacent flange aperture to join said base member front portion and said fin member front end portion in a pivotal manner.

15. The fin assembly as claimed in claim 14, wherein each said hinge pin includes opposed flat edges, and wherein each said aperture includes a slot sized and shaped to permit one said hinge pin to be selectively moved into and out of one said aperture and oriented so that said pins are movable through said slots when said fin member has achieved a projection angle relative to said base member lower surface of greater than 90°.

16. The fin assembly as claimed in claim 1, wherein said angle limiting mechanism comprises a flexible strap removably secured to the lower surface of said base member and the top surface of said fin member, the length of said strap being the limiting factor for said angle.

17. A fin assembly for attachment to the boot of a float tube user and adapted for selective movement between a first fully extended operating position for propelling the float tube user in a forwardly facing direction, a second return operating position to provide substantially reduced resistance to the flow of water as the fin assembly is moved in a forwardly direction relative to said user, and a retracted position for enabling the float tube user to walk on a surface, said boot having a sole, a toe and a heel, said fin assembly comprising:

a base member having a front portion, a rear portion, an upper surface and a lower surface;

a mechanism for releasably securing the upper surface of said base member to the sole of a boot;

a fin member having a front end portion, a rear end portion, a top surface and a bottom surface, said rear end portion having a width dimension greater than said front end portion;

an arrangement for mounting the front end portion of said fin member to the front portion of said base member to provide pivotal movement between said fin member retracted position, and a fin member base operational position wherein said fin member rear end portion projects at an acute attack angle below said base member lower surface, said fin member being adapted for movement between said fully extended operating position and said return operating position when locked in said base member operational position;

a device for limiting the maximum angle of attack between said fin member in its fully extended operating position and the plane of said base member lower surface;

a mechanism for releasably locking said fin member in said base operational position wherein said fin member front end portion projects at a predetermined angle below said base member lower surface; and a mechanism for releasably maintaining said fin member in said retracted position against said base member lower surface to enable a float tube user to walk on a land surface.

18. The fin assembly as claimed in claim 17, wherein said attack angle is increased relative to said predetermined angle when said fin member is moved to said first fully extended operating position and decreased when said fin member is moved to said second return operating position.

19. The fin assembly as claimed in claim 17, wherein said maximum angle of attack limiting device comprises a flexible strap removably secured to the lower surface of said base member and the top surface of said fin member, the length of said strap being the limiting factor for said attack angle, and wherein said predetermined angle is in the range of 60°–70°.

20. The fin assembly as claimed in claim 17, wherein said fin member comprises a pliable material capable of flexing in response to water pressure against said fin member top and bottom surfaces so as to enable said fin member to move between said first and second operating positions when secured in said base operational position.

21. The fin assembly as claimed in claim 17, wherein said fin assembly further comprises a traction mechanism disposed along the bottom surface of said fin member in the form of a plurality of raised cleat-like elements, and wherein said mechanism for releasably attaching the upper surface of said base member to the sole of a boot comprises adjustable strap members having breakaway connection elements as safety releases in the event that said assembly is caught on an obstruction during use.

22. The fin assembly as claimed in claim 17, wherein said mechanism for releasably maintaining said fin member in said retracted position comprises a latch mechanism interconnecting the rear end portion of said fin member and the rear portion of said base member and including a latch arm secured to said fin member rear end portion and terminating at one end thereof in a pawl, a catch member secured to said base member rear portion and adapted for releasable engagement with said pawl, and a spring bias element engaged with said latch arm adapted to urge said pawl into engagement with said catch member.

23. The fin assembly as claimed in claim 17, wherein said mechanism for releasably locking said fin member in said base operational position comprises a lever mechanism comprising a lever member having a pawl thereon and adapted for pivotal mounting on said fin member front end portion, a catch disposed on said base member front portion for selective engagement with said pawl, and a spring bias element interengaging said lever member and said fin member, said lever member being movable against the bias of said spring element to selectively disengage said pawl from said catch.

24. The fin assembly as claimed in claim 17, wherein said mounting arrangement for pivotal movement comprises a pair of spaced flanges disposed in the front end portion of said fin member each having an aperture therein, a pivot shoulder in the form of a pair of ledges disposed at the front portion of said base member, and a hinge pin mechanism adapted for removable positioning within said flange apertures and said pivot shoulder ledges, said hinge pin mechanism comprising a pin projecting outwardly from each said ledge with each said pin being adapted for insertion into an adjacent flange aperture to join said base member front portion and said fin member front end portion in a pivotal manner, and wherein each said hinge pin includes opposed flat edges, and each said aperture includes a slot sized and shaped to permit one said hinge pin to be selectively moved into and out of one said aperture and oriented so that said pins are movable Through said slots when said fin member has achieved a projection angle relative to said base member lower surface of greater than 90°.

25. In a fin assembly for attachment to the boot of a float tube user with said boot having a sole, a toe and a heel, said fin assembly including a base member having a front portion, a rear portion, an upper surface and a lower surface, a mechanism for releasably securing said base member to the sole of the float tube user's boot, a fin member having a front end portion, a rear end portion, a top surface and a bottom surface, and a hinging arrangement for mounting the front end portion of said fin member to the front portion of said base member to provide pivotal movement therebetween, said fin assembly being adapted for selective movement between an operating position for propelling the float tube user in a forwardly facing direction, a return position to provide substantially reduced resistance to the flow of water as the fin assembly is moved in a forwardly direction relative to said user, and a retracted position for enabling the float tube user to walk on a surface, the improvement wherein said fin assembly further comprises:

a mechanism for releasably locking said fin member in a base operational position wherein said fin member front end portion projects at a predetermined angle below said base member lower surface, said fin member moving between said fully extended operating position and said return position while locked in said base operational position;

a mechanism for releasably maintaining said fin member in said retracted position against said base member lower surface to enable a float tube user to walk on a land surface;

a device for limiting the maximum angle of attack between said fin member rear end portion in its fully extended operating position and the plane of said base member lower surface; and a traction mechanism disposed along the bottom surface of said fin member to assist the float tube user to walk on a flat surface.

26. The fin assembly improvement as claimed in claim 25, wherein said fin member comprises a pliable material capable of flexing in response to water pressure against said fin member top and bottom surfaces so as to enable said fin member to move between said fully extended operating position and said return position when said fin member front end portion remains locked in said base operational position.

27. The fin assembly improvement as claimed in claim 26, wherein the pliability of said fin member rear end portion is greater than the pliability of said fin member front end portion to provide increased feathering and flexing capability of said rear end portion relative to said front end portion when subjected to water pressure against said fin member top and bottom surfaces.

28. The fin assembly improvement as claimed in claim 27, wherein said mechanism for releasably locking said fin member in said base operational position comprises a lever mechanism comprising a lever member having a pawl thereon and adapted for pivotal mounting on said fin member front end portion, a catch disposed on said base member front portion for selective engagement with said pawl, and a spring bias element interengaging said lever member and said fin member front end portion, said lever member being movable against the bias of said spring element to selectively disengage said pawl from said catch to release said fin member from its base operational position.

29. The fin assembly improvement as claimed in claim 25, wherein said mechanism for releasably maintaining said fin member in said retracted position comprises a latch mechanism interconnecting the rear end portion of said fin member and the rear portion of said base member and including a latch arm secured to said fin member rear end portion and including a pawl at one end thereof, a catch member secured to said base member rear portion and adapted for releasable engagement with said pawl, and a spring bias element engaged with said latch arm adapted to urge said pawl into engagement with said catch member.

30. The fin assembly improvement as claimed in claim 25, wherein said base member lower surface includes a T-shaped connecting element projecting downwardly therefrom, and wherein said maximum angle of attack limiting device comprises a flexible strap removably secured at one end to said T-shaped element and at its opposite end to the top surface of said fin member, the length of said strap being the limiting factor for said angle.

31. The fin assembly improvement as claimed in claim 25, wherein said traction mechanism comprises a plurality of raised cleats projecting outwardly from the bottom surface of said fin member, and wherein said mechanism for releasably securing the upper surface of said base member to the sole of a boot comprises adjustable strap members having breakaway connection elements.

32. A fin assembly for attachment to a boot having a sole, a toe and a heel portion, said assembly comprising:

a fin member having a front portion, a rear portion, an upper surface and a bottom surface, said rear portion having a width dimension greater than said front portion;

a hinge mechanism for securing the front portion of said fin member proximate the toe of said boot to provide rotational movement of said fin member at its front portion between a base operational position wherein said fin member front portion projects below said boot sole to form a fixed acute angle between said fin member and the plane of said sole, and a retracted position for enabling the float tube user to walk on a flat surface;

means for enabling said fin member, when secured in said base operational position, to move between a first fully extended operating position wherein said fin member rear end portion is extended to maximize resistance to flow of water against said fin member upper surface as said fin member is moved in a rearward direction relative to the user for propelling the user forwardly in the water, and a second return operating position wherein said fin member rear portion is feathered rearwardly and upwardly toward said boot sole to provide substantially reduced resistance to flow of water across said fin member bottom surface as said fin member is moved in a forward direction relative to said user for resetting said fin member to its fully extended operating position; and means for limiting the maximum angle between said fin member rear end portion in its fully extended operational position and the plane of the sole of said boot.

33. The fin assembly as claimed in claim 32, wherein said fin assembly further includes a mechanism for releasably locking said fin member in said retracted position to enable a float tube user to walk on a land surface.

34. The fin assembly as claimed in claim 32, wherein said fin assembly further includes a mechanism for releasably locking said fin member in its base operational position wherein said fin member front end portion projects at a predetermined fixed angle below said base member lower surface.

35. The fin assembly as claimed in claim 32, wherein said means for enabling said fin member, when secured in said base operational position, to move between a first fully extended operating position and a second return operating position comprises said fin member being formed from a pliable material capable of flexing in response to water pressure against said fin member top and bottom surfaces.

* * * * *